US009201378B2

(12) United States Patent
Asaoka et al.

(10) Patent No.: US 9,201,378 B2
(45) Date of Patent: Dec. 1, 2015

(54) CLEANING UNIT, PROCESS CARTRIDGE INCORPORATING SAME, AND IMAGE FORMING APPARATUS INCORPORATING SAME

(71) Applicants: Akira Asaoka, Kanagawa (JP); Hirotaka Hatta, Kanagawa (JP); Toshiya Sato, Kanagawa (JP); Takeshi Kojima, Kanagawa (JP); Hiroyuki Uenishi, Kanagawa (JP); Yusuke Ishizuka, Kanagawa (JP)

(72) Inventors: Akira Asaoka, Kanagawa (JP); Hirotaka Hatta, Kanagawa (JP); Toshiya Sato, Kanagawa (JP); Takeshi Kojima, Kanagawa (JP); Hiroyuki Uenishi, Kanagawa (JP); Yusuke Ishizuka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/168,308

(22) Filed: Jan. 30, 2014

(65) Prior Publication Data

US 2014/0233997 A1 Aug. 21, 2014

(30) Foreign Application Priority Data

Feb. 15, 2013 (JP) ..... 2013-028399

(51) Int. Cl.
*G03G 21/00* (2006.01)

(52) U.S. Cl.
CPC ..... *G03G 21/0035* (2013.01); *G03G 21/0011* (2013.01)

(58) Field of Classification Search
CPC ..... G03G 21/0035
See application file for complete search history.

(56) References Cited

U.S. PATENT DOCUMENTS

| | | | | | |
|---|---|---|---|---|---|
| 3,848,994 | A | * | 11/1974 | Fraser | 399/354 |
| 4,660,962 | A | * | 4/1987 | Maekawa et al. | 399/354 |
| 4,870,466 | A | * | 9/1989 | Iida | 399/129 |
| 5,212,530 | A | * | 5/1993 | Harada et al. | 399/349 |
| 5,233,398 | A | * | 8/1993 | Nimura et al. | 399/354 |
| 5,260,754 | A | * | 11/1993 | Yano et al. | 399/123 |
| 5,669,041 | A | * | 9/1997 | Thayer et al. | 399/102 |

(Continued)

FOREIGN PATENT DOCUMENTS

| | | | |
|---|---|---|---|
| JP | 10143036 | A * | 5/1998 |
| JP | 2006-154796 | | 6/2006 |

(Continued)

OTHER PUBLICATIONS

U.S. Appl. No. 13/974,768, filed Aug. 23, 2013.

(Continued)

*Primary Examiner* — David Gray
*Assistant Examiner* — Geoffrey Evans
(74) *Attorney, Agent, or Firm* — Oblon, McClelland, Maier & Neustadt, L.L.P.

(57) ABSTRACT

A cleaning unit, which is included in a process cartridge or an image forming apparatus, includes a brush rotary body to remove toner, a toner collecting rotary body to collect the toner, a toner collecting blade to scrape the toner, and a cleaning blade to scrape the toner falling from the brush rotary body. The image carrier, the brush rotary body, and the toner collecting rotary body rotate in the same direction. The cleaning blade, the brush rotary body, and the toner collecting rotary body are located to cause a tangential line passing through a contact area of the brush rotary body and the toner collecting rotary body on an outer peripheral circle around a shaft of the brush rotary body to have an intersection point intersecting a non-contact surface of the cleaning blade disposed opposite to a contact portion of the cleaning blade with the image carrier.

19 Claims, 7 Drawing Sheets

(56) References Cited

U.S. PATENT DOCUMENTS

| | | | | |
|---|---|---|---|---|
| 5,671,476 | A * | 9/1997 | Ishiguro et al. | 399/354 |
| 5,991,568 | A * | 11/1999 | Ziegelmuller et al. | 399/102 |
| 5,999,791 | A * | 12/1999 | Ogawa et al. | 399/354 |
| 6,539,197 | B2 * | 3/2003 | Waterschoot | 399/353 |
| 7,228,099 | B2 * | 6/2007 | Shintani et al. | 399/346 |
| 7,668,480 | B2 * | 2/2010 | Nakayama et al. | 399/101 |
| 8,019,268 | B2 * | 9/2011 | Nakamatsu et al. | 399/349 |
| 2001/0026718 | A1 * | 10/2001 | Okubo | 399/353 |
| 2006/0127145 | A1 * | 6/2006 | Honda et al. | 399/349 |
| 2008/0101834 | A1 * | 5/2008 | Iwasaki | 399/357 |
| 2009/0092428 | A1 * | 4/2009 | Yano et al. | 399/349 |
| 2010/0003052 | A1 * | 1/2010 | Nakamatsu et al. | 399/123 |
| 2010/0008706 | A1 * | 1/2010 | Sugiura et al. | 399/350 |
| 2010/0247123 | A1 | 9/2010 | Honjoh et al. | |
| 2012/0034006 | A1 * | 2/2012 | Asaoka et al. | 399/343 |
| 2012/0087704 | A1 | 4/2012 | Asaoka et al. | |
| 2012/0099883 | A1 | 4/2012 | Kikuchi et al. | |
| 2013/0315617 | A1 * | 11/2013 | Sugiura et al. | 399/101 |
| 2015/0063887 | A1 * | 3/2015 | Asaoka et al. | 399/353 |

FOREIGN PATENT DOCUMENTS

| | | |
|---|---|---|
| JP | 2007-133034 | 5/2007 |
| JP | 2011-039427 | 2/2011 |
| JP | 2011-128363 | 6/2011 |

OTHER PUBLICATIONS

U.S. Appl. No. 14/026,263, filed Sep. 13, 2013.

* cited by examiner

CLEANING UNIT, PROCESS CARTRIDGE INCORPORATING SAME, AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2013-028399, filed on Feb. 15, 2013 in the Japan Patent Office, the entire disclosure of which is hereby incorporated by reference herein.

BACKGROUND

1. Technical Field

Embodiments of the present invention relate to a cleaning unit, a process cartridge incorporating the cleaning unit, and an image forming apparatus incorporating the cleaning unit or the process cartridge.

2. Related Art

Electrophotographic image forming apparatuses include a cleaning mechanism in which residual toner on a photoconductor is cleaned and collected. For example, Japanese Patent Application Publication No. JP 2007-133034-A discloses a technique in which a cleaner includes a cleaning brush that is charged and disposed at an upstream side of a photoconductor in a rotation direction thereof and a cleaning blade is disposed downstream from the cleaning brush in the rotation direction. The cleaning brush and the cleaning blade remove residual toner remaining on the photoconductor together. Thereafter, a collection roller that is charged and contacted with the cleaning brush collects toner that is collected and held on the cleaning brush.

However, in the technique disclosed in JP 2007-133034-A, the cleaning brush and the collection roller rotate in the same direction, and therefore the cleaning brush contacting the collection roller flicks off the toner that cannot be collected by the collection roller, which causes the toner to be attached to the photoconductor again.

SUMMARY

At least one embodiment of the present invention provides a cleaning unit including a brush rotary body, a toner collecting rotary body, a toner collecting blade, and a cleaning blade. The brush rotary body is disposed in contact with an image carrier provided in an image forming apparatus and removes toner on the image carrier and holding the toner thereon. The toner collecting rotary body is disposed in contact with the brush rotary body and collects the toner held on the brush rotary body. The toner collecting blade is disposed in contact with the toner collecting rotary body and scrapes the toner adhered to the toner collecting rotary body. The cleaning blade is disposed in contact with the image carrier at a downstream side from the brush rotary body in a rotation direction of the image carrier and scrapes the toner falling from the brush rotary body. The image carrier, the brush rotary body, and the toner collecting rotary body rotate in the same direction. The cleaning blade, the brush rotary body, and the toner collecting rotary body are located to cause a tangential line passing through a contact area of the brush rotary body and the toner collecting rotary body on an outer peripheral circle around a shaft of the brush rotary body to have an intersection point intersecting a non-contact surface of the cleaning blade disposed opposite to a contact portion of the cleaning blade with the image carrier.

Further, at least one embodiment of the present invention provides a process cartridge detachably attachable to an apparatus body of an image forming apparatus including the above-described cleaning unit and at least one of an image carrier to form an image on a surface thereof, a charger to uniformly charge the image carrier, and a development device to develop an image on the image carrier charged by the charger.

Further, at least one embodiment of the present invention provides an image forming apparatus including an image forming device to form an image on a recording medium, and the above-described cleaning unit.

BRIEF DESCRIPTION OF THE DRAWINGS

A more complete appreciation of the invention and many of the advantages thereof will be obtained as the same becomes better understood by reference to the following detailed description when considered in connection with the accompanying drawings, wherein.

DETAILED DESCRIPTION

Figure 1:
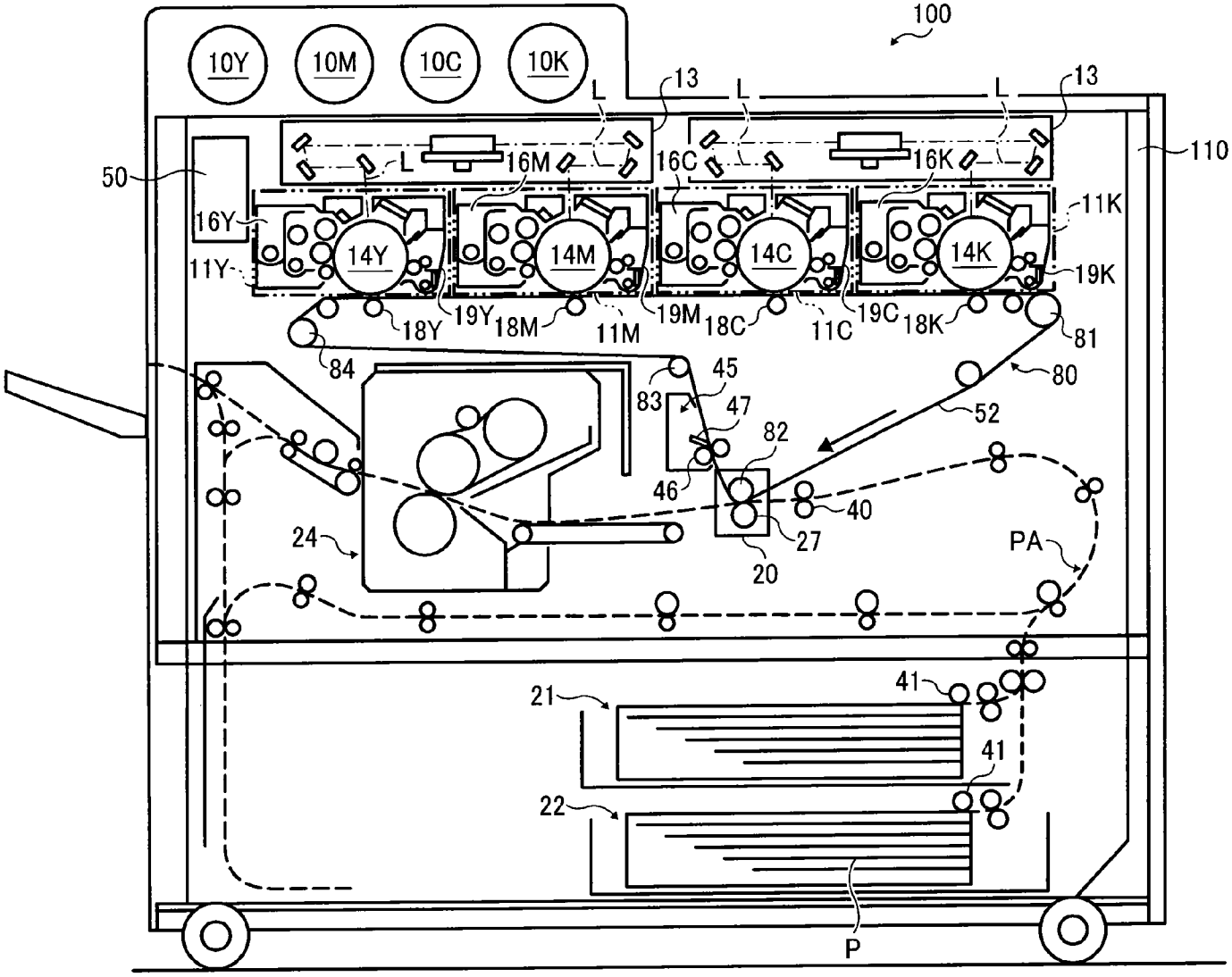
FIG. 1 is a front view illustrating a schematic configuration of an image forming apparatus including a cleaning unit according to an embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present invention.

The terminology used herein is for describing particular embodiments and is not intended to be limiting of exemplary embodiments of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of the present invention. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of the present invention.

The present invention is applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of the present invention are described.

Now, a description is given of a whole configuration and functions of an image forming apparatus 100 including a cleaning unit 19 according to the present embodiment with reference to FIG. 1.

FIG. 1 is a front view illustrating a schematic configuration of an image forming apparatus 100 according to an embodiment of the present invention and the cleaning unit 19 incorporated therein.

The image forming apparatus 100 may be a copier, a facsimile machine, a printer, a multifunction peripheral or a multifunction printer (MFP) having at least one of copying, printing, scanning, facsimile, and plotter functions, or the like. According to the present embodiment, the image forming apparatus 1 is an electrophotographic color printer that forms color and monochrome toner images on recording media by electrophotography.

As illustrated in FIG. 1, the image forming apparatus 100 includes an intermediate transfer unit 80 at a substantially center of the apparatus body 110.

The intermediate transfer unit 80 includes an intermediate transfer belt 52. The intermediate transfer belt 52 functions as an image carrier and an intermediate transfer body having an endless form. The intermediate transfer belt 52 is wound about multiple support rollers with tension in a loop.

The multiple support rollers include a drive roller 81, a secondary transfer backup roller 82, driven rollers 83 and 84, and four primary transfer rollers 18Y, 18C, 18M, and 18K. The drive roller 81 rotates clockwise in FIG. 1. The secondary transfer backup roller 82 is an opposed roller disposed facing a secondary transfer roller 27. The suffixes "Y", "C", "M", and "K" provided after the primary transfer rollers 18Y, 18C, 18M, and 18K represent that the respective primary transfer rollers are for producing yellow, cyan, magenta, and black images.

The intermediate transfer belt 52 is stretched around the drive roller 81, the secondary transfer backup roller 82, the driven rollers 83 and 84, and the primary transfer rollers 18Y, 18C, 18M, and 18K in a substantially inverted triangle shape.

Process cartridges 11Y, 11C, 11M, and 11K (hereinafter, also referred to as a process cartridge 11) are disposed along a horizontal direction above a stretched surface that is equivalent to the bottom line of the inverted triangle of the intermediate transfer belt 52. The process cartridges 11Y, 11C, 11M, and 11K function as image forming units.

The process cartridge 11Y accommodates yellow image forming parts and components. Yellow toner images formed in the process cartridge 11Y are transferred onto a surface of the intermediate transfer belt 52. Similarly, the process cartridges 11C, 11M, and 11K accommodate magenta, cyan, and black image forming parts and components, and magenta, cyan, and black toner images formed in the process cartridges 11C, 11M, and 11K are transferred onto the surface of the intermediate transfer belt 52 at respective primary transfer positions where the magenta, cyan, and black toner images face the primary transfer rollers 18C, 18M, and 18K, respectively. The respective color toner images are overlaid on the surface of the intermediate transfer belt 52 to be a composite toner image. The composite toner image is conveyed to the secondary transfer part 20 as the intermediate transfer belt 52 endlessly moves in a loop.

In FIG. 1, an exposure unit pair (optical writing unit pair) 13 is disposed above the process cartridges 11Y, 11C, 11M, and 11K. The exposure unit pair 13 includes an exposure unit for yellow and magenta images and an exposure unit for cyan and black images to emit respective laser light beams L based on image data to respective photoconductor drums 14Y, 14C, 14M, and 14K, each functioning as an image carrier. The exposure unit pair 13 receives data of each color based on image data of an original document transmitted from a scanner to a controller 50. Then, a laser controller drives four semiconductor lasers to emit the four laser light beams L.

Thereafter, the laser light beams L scan the photoconductor drums 14Y, 14C, 14M, and 14K (hereinafter, also referred to as a photoconductor drum 14) of the process cartridges 11Y, 11C, 11M, and 11K to write yellow, cyan, magenta, and black electrostatic latent images on respective outer circumferential surfaces of the photoconductor drums 14Y, 14C, 14M, and 14K.

In FIG. 1, the image forming apparatus 100 further includes a secondary transfer part 20, sheet feeding units 21 and 22, a fixing unit 24, and toner bottles 10Y, 10C, 10M, and 10K. The secondary transfer part 20 secondarily transfers a full-color toner image formed on the intermediate transfer belt 52 onto a recording medium P serving as a sheet-shaped recording medium. Each of the sheet feeding units 21 and 22 accommodates a stack of recording medium P therein. The fixing unit 24 fixes unfixed toner image to the recording medium P.

Figure 2:
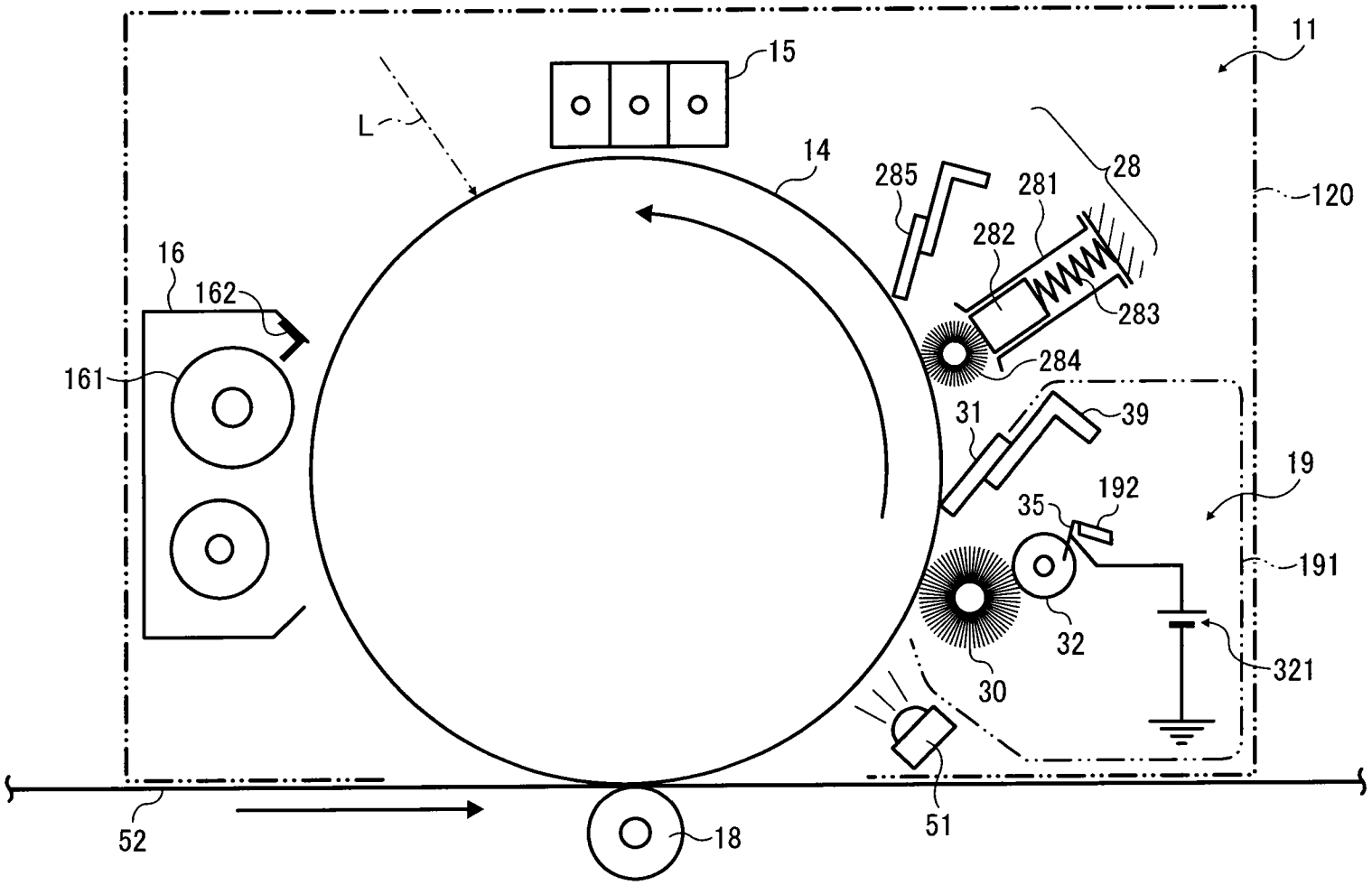
FIG. 2 is a cross-sectional view illustrating a process cartridge included in the image forming apparatus and adjacent units.

Next, a description is given of a structure and functions of the process cartridge 11 with reference to FIGS. 1 and 2. Since the elements or components of the process cartridges 11Y, 11C, 11M, and 11K are identical in structure and functions except for toner colors, the description of the process cartridge 11 can be applied to any one of the process cartridges 11Y, 11C, 11M, and 11K.

In FIGS. 1 and 2, the image forming apparatus 100 further includes a charger 15, a development unit 16, a cleaning unit 19, an electric discharging lamp 51, and a lubricant applicator 28 in the process cartridge 11. The charger 15 uniformly charges the surface of the photoconductor drum 14. The development unit 16 develops an electrostatic latent image formed on the surface of the photoconductor drum 14 into a toner image. The cleaning unit 19 collects residual toner remaining on the surface of the photoconductor drum 14. The electric discharging lamp 51 electrically discharges residual potential remaining on the surface of the photoconductor drum 14.

The photoconductor drum 14 and the units and components disposed around the photoconductor drum 14 are supported by a casing 120 illustrated with a two-dot chain line in FIG. 2. The casing 120, the photoconductor drum 14 and the units and components form the single process cartridge 11. The process cartridge 11 is detachably attached to the apparatus body 110 integrally via the casing 120. By so doing, maintainability of the process cartridge 11 is enhanced.

Next, a description is given of image forming operations of the process cartridge 11.

Image data is transmitted from the scanner to the controller 50 to be separated into four colors. The image data of each color is converted into electric signals and transmitted to the exposure unit pair 13. Then, the laser light beam L based on the image data converted into the electric signals are emitted to the photoconductor drum 14.

The photoconductor drum 14 rotates counterclockwise in FIG. 2 to uniformly charge the outer circumferential surface (hereinafter, also referred to as a surface) at a position the photoconductor drum 14 faces the charger 15. The charged surface of the photoconductor drum 14 comes to face an irradiation position of the laser light beam L, where an electrostatic latent image corresponding to the image data is formed on the surface of the photoconductor drum 14.

The electrostatic latent image formed on the surface of the photoconductor drum 14 comes to a position facing the development unit 16, so that the electrostatic latent image is developed to a visible toner image. It is to be noted that toner in the developer contained in the development unit 16 is mixed with toner supplied by a toner hopper and carriers by an agitating roller. The thus frictionally charged toner is supplied onto a development roller 161 together with the carrier. Thereafter, the toner held on the development roller 161 passes by a doctor blade 162 to be regulated in height, and comes to a position facing the photoconductor drum 14. At this position, the toner is attracted to the electrostatic latent image formed on the photoconductor drum 14. It is to be noted that the toner supplied by the toner hopper is supplied suitably as the toner in the development unit 16 is consumed and that the toner consumption state in the development unit 16 is detected by an optical sensor or a toner density sensor.

The surface of the photoconductor drum 14 with the toner image developed by the development unit 16 then comes to a position facing the primary transfer roller 18. At this position, the toner image formed on the photoconductor drum 14 is primarily transferred onto the intermediate transfer belt 52.

After this primary transfer of the toner image onto the intermediate transfer belt 52, a small amount of toner that has not been transferred onto the intermediate transfer belt 52 remains on the surface of the photoconductor drum 14. Here, the electric discharging lamp 51 emits light to remove residual electrostatic potential remaining on the surface of the photoconductor drum 14 that has passed the primary transfer roller 18 so as to reset the potential. After the residual electric potential is removed, the surface of the photoconductor drum 14 having residual toner thereon reaches the cleaning unit 19 according to the present embodiment.

The cleaning unit 19 includes a container 191 illustrated with a two-dot chain line in FIG. 2. The container 191 contains a cleaning brush 30 and a metallic blade 35. The cleaning brush 30 is in contact with the photoconductor drum 14 and is positively charged. The metallic blade 35 is negatively charged by a charger 321. With this configuration of an electrostatic remover, the residual toner remaining on the photoconductor drum 14 is collected.

Residual toner unremoved by the cleaning brush 30 moves forward to the cleaning blade 31 disposed downstream from the cleaning brush 30 in a rotation direction of the photoconductor drum 14 as indicated by arrow in FIG. 2. The cleaning blade 31 is a urethane rubber (an elastic material) and has a strip plate of a rectangular cross-section. The cleaning blade 31 is attached to the container 191 that is disposed close to a casing 129 via a supporting bracket 39 that serves as a blade supporting member. The cleaning blade 31 reliably scrapes and removes a relatively small amount of residual toner that has not been removed by the cleaning brush 30.

Figure 3:
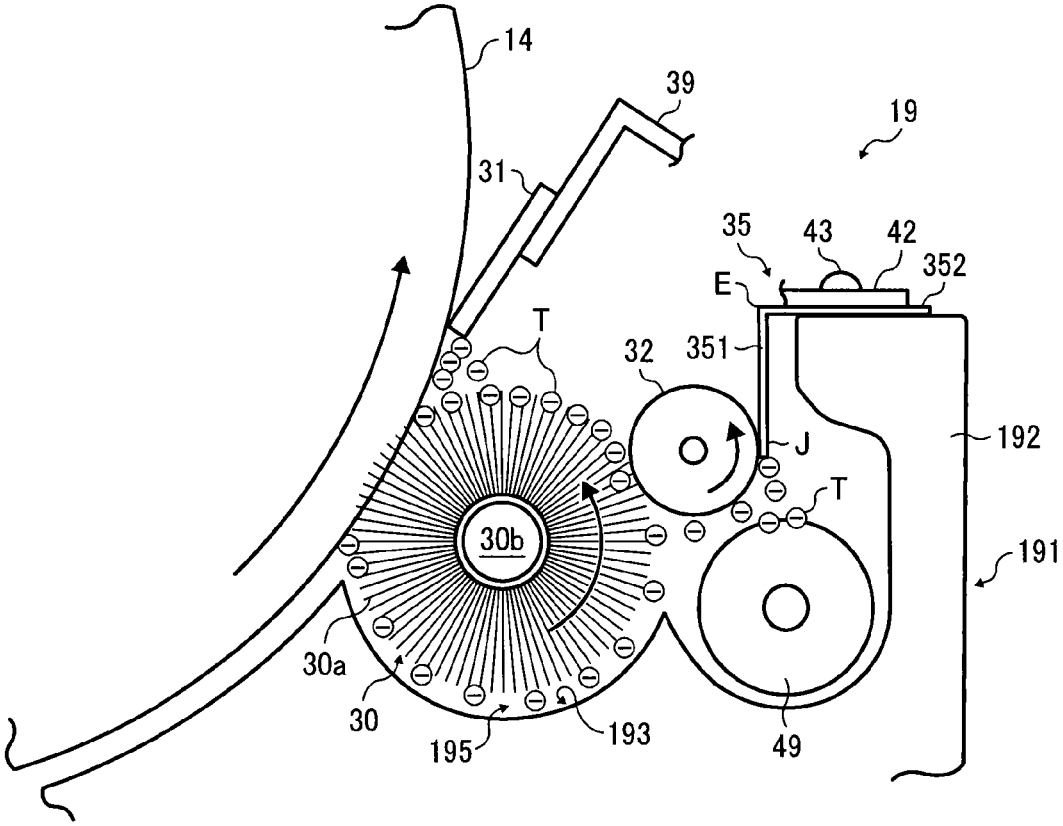
FIG. 3 is an enlarged cross-sectional view illustrating the cleaning unit included in the process cartridge of FIG. 2.

The toner collected by the cleaning unit 19 that includes the cleaning brush 30 and the cleaning blade 31 is regarded as waste toner and conveyed toward a waste toner bottle along a waste toner conveying path via a conveyance screw 49 (see FIG. 3). A detailed configuration of the cleaning unit 19 is described below.

It is to be noted that both the cleaning blade 31 and the supporting bracket 39 extend throughout a whole length in a longitudinal direction (or an axial direction) of the photoconductor drum 14 in the present embodiment. It is preferable that a portion where the cleaning blade 31 is supported and fixed by the supporting bracket 39 is closely contacted to the photoconductor drum 14 through the whole length in the longitudinal direction of the photoconductor drum 14 so that residual toner that is flicked by the cleaning brush 30.

After the residual toner remaining on the surface of the photoconductor drum 14 is removed by the cleaning unit 19, the lubricant application device 28 applies wax functioning as lubricant (such as stearic acid amide) to the surface of the photoconductor drum 14, so that the outer surface of the photoconductor drum 14 is protected.

The lubricant application device 28 includes a lubricant casing 281, a solid wax 282, a spring 283, and a ropotary brush 284. The solid wax 282 is a stearic acid amide material. The solid wax 282 is relocatably disposed in the lubricant casing 281. The spring 283 is a compression spring that biases the wax 282 toward a direction in which the wax 282 projects to contact the surface of the photoconductor drum 14. The rotary brush 284 is linked to a motor and is rotated appropriately to apply wax powder scraped by its leading edge in contact with a surface of the wax 282 to the surface of the photoconductor drum 14.

An application blade 285 is disposed at a position downstream from the rotary brush 284 in the rotation direction of the photoconductor drum 14. The application blade 285 regulates the wax powder to be attached uniformly on the outer surface of the photoconductor drum 14. The configuration provided with the application blade 285 can appropriately adjust the thickness of a layer of wax powder scraped from the wax 282 and prevent the cleaning blade 31 on the side of the cleaning unit 19, as described below.

As described above, the respective single color toner images formed by the process cartridges 11Y, 11C, 11M, and 11K are sequentially transferred and overlapped onto the intermediate transfer belt 52. Then, the color toner image primarily transferred onto the intermediate transfer belt 52 is conveyed to the secondary transfer part 20 along with movement of the intermediate transfer belt 52.

The recording medium P is fed and conveyed to the secondary transfer part 20 according to the following operations. As illustrated in FIG. 1, one of the sheet feeding units 21 and 22 of the image forming apparatus 100 is selected automatically or manually (with an operation unit). In the present embodiment, the sheet feeding unit 21 disposed above the sheet feeding unit 22 is selected. By driving a feed roller 41, one recording medium P of the recording media accommodated in the sheet feeding unit 21 is fed into a sheet conveying path PA. After passing through the sheet conveying path PA, the recording medium P reaches a registration roller pair 40 and stops. Since the registration roller pair 40 rotates at a given timing, the recording medium P is fed toward the secondary transfer part 20 in synchronization of the toner image on the intermediate transfer belt 52.

In the secondary transfer part 20, the toner image is transferred onto the recording medium P in the transfer process. After passing the secondary transfer part 20, the recording medium P is conveyed to the fixing device 24 via the sheet conveying path PA.

The fixing device 24 fixes the unfixed toner image formed on the recording medium P to the recording medium P by application of heat and pressure. The recording medium P having the fixed toner image is discharged as an output image to the outside of the image forming apparatus 100.

It is to be noted that, when the intermediate transfer belt 52 after passing the secondary transfer part 20 reaches a belt cleaning unit 45, a scraping blade 47 scrapes residual toner remaining on the surface of the intermediate transfer belt 52 at a position facing a guide roller 46 of the belt cleaning unit 45. Here, the guide roller 46 applies a given tension to the intermediate transfer belt 52 and facilitates a scraping action of the scraping blade 47. It is to be noted that the scraping blade 47 has a shorter life than the intermediate transfer belt 52 and therefore is replaced suitably before the life thereof is expired.

With this operation, a series of image forming processes is finished.

Next, a description is given of a configuration of the cleaning unit 19 that removes residual toner remaining on the surface of the photoconductor drum 14 of the process cartridge, with reference to FIGS. 1 through 3.

As illustrated in FIGS. 1 through 3, the cleaning units 19Y, 19M, 19C, and 19K (hereinafter, referred to as a cleaning unit 19) remove residual toner on the respective surfaces of the photoconductor drums 14Y, 14M, 14C, and 14K (hereinafter, referred to as a photoconductor drum 14).

As illustrated in FIG. 3, the cleaning unit 19 includes the cleaning brush 30, a metallic roller 32, the metallic blade 35, the conveyance screw 49, and the cleaning blade 31. The cleaning brush 30 functions as a brush rotary body or a fabric rotary body, which contacts the surface of the photoconductor drum 14, removes residual toner from the surface of the photoconductor drum 14, and holds the collected residual toner therewith. The metallic roller 32 functions as a toner collecting rotary body that contacts the cleaning brush 30, and collects toner held by the cleaning brush 30. The metallic blade 35 functions as a toner collecting blade that contacts the metallic roller 32 and scrapes the toner attached to the metallic roller 32. The conveyance screw 49 functions as a waste toner conveying member that discharges waste toner to a waste toner bottle. The cleaning blade 31 is disposed downstream from the cleaning brush 30 in the rotation direction of the photoconductor drum 14. The cleaning blade 31 functions as a cleaning blade member that contact the photoconductor drum 14 and scrapes toner T slipped through the cleaning brush 30.

As illustrated in FIG. 3, the cleaning brush 30 rotates counterclockwise, which is the same rotation direction as the photoconductor drum 14. By so doing, the cleaning brush 30 removes residual toner remaining on the surface of the photoconductor drum 14 and keeps the residual toner attached thereon. The metallic roller 32 disposed in contact with the cleaning brush 30 rotates counterclockwise in FIG. 3, so that the toner T held on the outer circumferential surface of the cleaning brush 30 is attached and collected to the outer circumferential surface thereof. The metallic blade 35 elastically contacts the edge J to the surface of the metallic roller 32 to mechanically remove the toner T.

The cleaning brush 30 and the metallic roller 32 are rotatably supported by a pair of sidewalls 194*a* and 194*b* (refer to FIG. 7) provided with the container 191 extending in a direction perpendicular to the surface of the drawing and is disposed at the front and back sides of the drawing. The cleaning brush 30, the metallic roller 32, and the metallic blade 35 extend in an axial direction (a longitudinal direction) of the photoconductor drum 14. The cleaning brush 30 and the metallic roller 32 are rotatably connected to a drive motor functioning as a drive unit via drive transmission members such as gears.

The container 191 further includes an attaching portion 192 and a brush facing recess 193. The attaching portion 192 attaches and fixes the metallic blade 35 as described below. The brush facing recess 193 is disposed facing an outer circumference of the cleaning brush 30. Both the attaching portion and the brush facing recess 193 extend in an axial direction (a longitudinal direction) of the photoconductor drum 14.

As described above, the cleaning brush 30, the metallic roller 32, and the metallic blade 35 are included in the container 191. The cleaning brush 30, the metallic roller 32, and the metallic blade 35 are surrounded and disposed facing the cleaning blade 31, the supporting bracket 39, and the pair of sidewalls 194*a* and 194*b*.

Since the cleaning brush 30 rotates counterclockwise, the toner T faces the metallic roller 32 and the metallic blade 35 after having passed through a clearance 195 between the cleaning brush 30 and the brush facing recess 193 on the side of the attaching portion 192 of the container 191. Therefore, the scraped toner T can flow down to the conveyance screw 49 disposed directly below the metallic roller 32 and the metallic blade 35 easily, which can shorten the length of the toner removal path and prevent toner dispersion.

It is to be noted that, as the configuration of the present embodiment uses a negatively charged toner as described above, the cleaning brush 30, the metallic roller 32, and the metallic blade 35 are positively charged. By contrast, when a configuration that uses a positively charged toner is used, the cleaning brush 30, the metallic roller 32, and the metallic blade 35 are to be charged negatively.

Here, the characteristic values of the cleaning brush 30 and the metallic roller 32 of the cleaning unit 19 are described. In FIG. 3, the cleaning brush 30 includes a bristle 30*a* that is a unit of bristles as brush fabric planted on the cleaning brush 30.

[Cleaning Brush 30]

Material of Bristle Fiber: conductive polyester.

Diameter: 18 mm.

Length of Bristle Fiber: 5 mm.

Bite Amount to Photoconductor Drum 14: 1 mm.

Linear Velocity: 224 mm/sec to 246 mm/sec (contact with the photoconductor drum 14 in a counter direction).

Volume Resistivity (Electric Positivity) of Bristle (Original Thread): $10^8$ Ω·cm.

Brush Bristle Density: 20,000 bristles/inch$^2$.

Material of Shaft 30*b*: Free Cutting Steel (SUM).

The cleaning brush 30 is planted with the conductive polyester brush fabric around a shaft 30*b* of a free cutting steel (SUM).

[Metallic Roller 32: Collection Roller]

Material: Stainless Steel (SUS).

Diameter: 11 mm.

Velocity: 122 mm/sec to 133 mm/sec.

Voltage: 1200V. However, the voltage value is variable on the basis of control (600V-1200V).

The above-described voltage is applied by the charger 321 and the metallic blade 35. The metallic blade 35 is disposed at a position facing the cleaning brush 30 via the metallic roller 32.

It is to be noted that the linear velocity of the cleaning brush 30 and the linear velocity of the metallic roller 32 are different according to the process linear velocity.

[Metallic Blade 35]

Material: Phosphor Bronze Thin Plate.

Thickness: Thin, bent plate having t=0.15 mm is used. Thin plate having t=0.1 mm through 0.6 mm can also be applied. The metallic blade 35 is disposed facing the metallic roller 32 and extending along a longitudinal direction of the metallic roller 32. The metallic blade 35 is fixed to the attaching portion 192 on the side of the container 191 of the cleaning unit 19 with screws 43 via the fixing member 42.

Here, the metallic blade 35 is bent to a cross-sectional L shape as illustrated in FIG. 3 and extends linearly in a direction perpendicular to the cross section (the drawing sheet) of the same L shape. One side of a bent portion E in the cross-sectional L shape is formed as an edge side part 351 and the other side thereof is formed as a fixed side part 352. The edge side part 351 has an edge J and is attached such that the edge J uniformly contacts an outer surface of the metallic roller 32.

Figure 4:
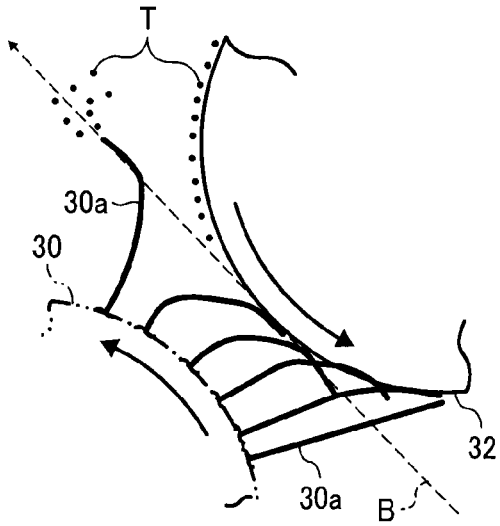
FIG. 4 is an enlarged front view illustrating movement of a cleaning brush at a contact portion of the cleaning brush and a metallic roller.
Figure 5:
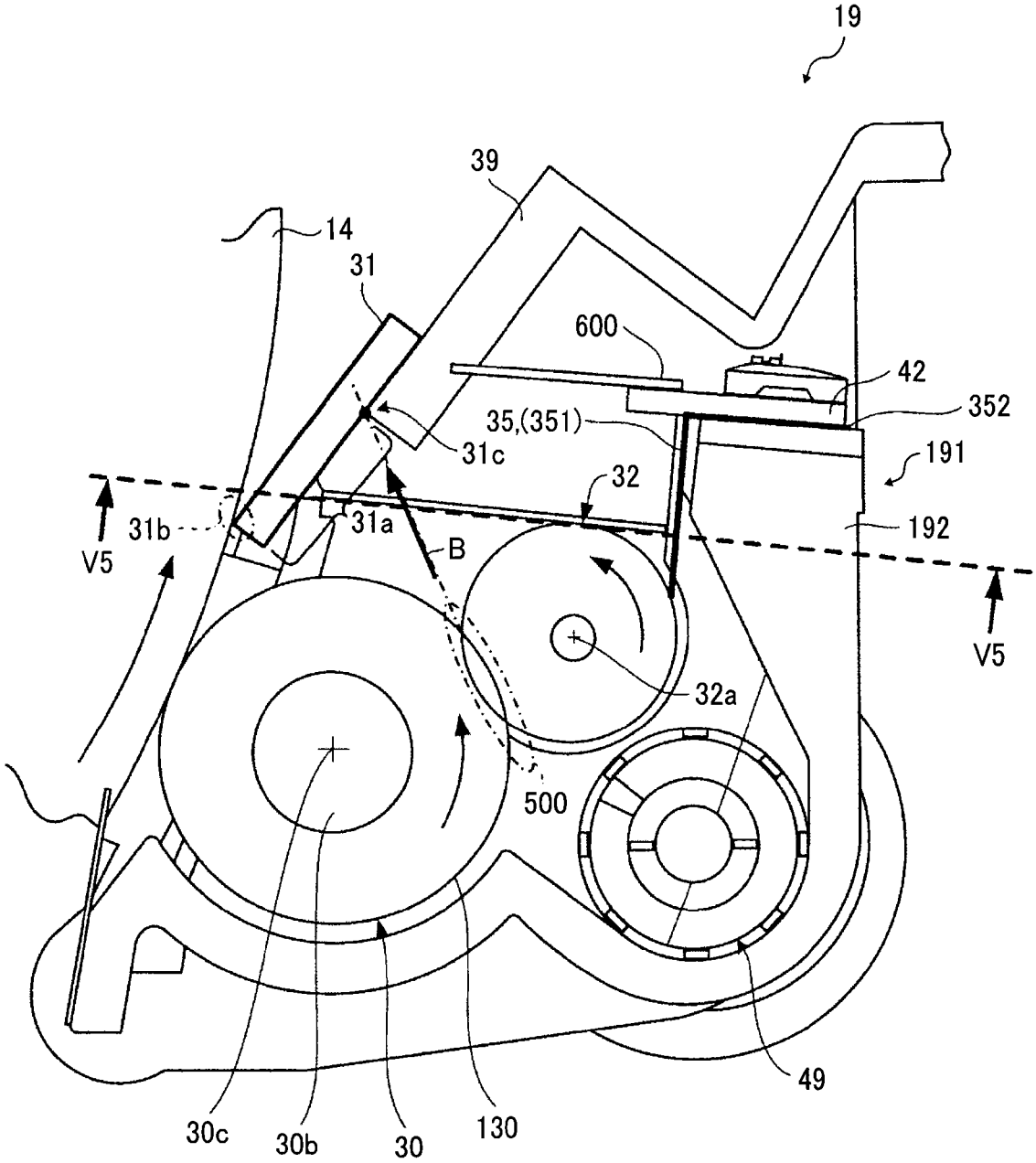
FIG. 5 is an enlarged cross-sectional view illustrating positions of the cleaning brush, the metallic roller, and a cleaning blade and a position of a seal.

A description is given of movement of the cleaning brush 30 at a portion in contact with the metallic roller 32 and a configuration of the cleaning brush 30, the metallic roller 32, and the cleaning blade 31, with reference to FIGS. 4 and 5.

FIG. 4 is an enlarged view illustrating the cleaning brush 30 and the metallic roller 32 to show how the bristle 30*a* of the cleaning brush 30 moves. FIG. 5 is an enlarged cross sectional view illustrating a positional configuration of the cleaning brush 30, the metallic roller 32, and the cleaning blade 31 and a position of a seal 600.

As illustrated in FIG. 4, when the cleaning brush 30 contacts the metallic roller 32, each tip of the bristles 30*a* of the cleaning brush 30 or each leading area of the bristles 30*a* or each top of the bristles 30*a* (hereinafter, referred to as the "leading area of the bristles 30*a*) contacts the metallic roller 32 while being bent toward an upstream side in the rotation direction of the cleaning brush 30. Then, the leading area of the bristles 30*a* of the cleaning brush 30 backswings to its original posture by elastically changing the posture toward a downstream side in the rotation direction of the cleaning brush 30 as the leftmost bristle 30*a* illustrated in FIG. 4. This restoration of the posture of the bristle 30*a* causes a flicking to flick off the residual toner T attached to the leading area of the bristle 30*a* toward the same direction as a tangential line B indicated by broken arrow in FIG. 4. Specifically, the residual toner T removed by the cleaning brush 30 is mechanically flicked off in a direction of the tangential line B of an outer peripheral circle 130 rotating on the shaft 30*b* as a rotation center of the cleaning brush 30 at a contact area 500 of the cleaning brush 30 and the metallic roller 32 in FIG. 5.

To address this inconvenience, the cleaning brush 30, the metallic roller 32, and the cleaning blade 31 are disposed such that the tangential line B has an intersection point 31*c* to intersect a non-contact surface 31*a* that is disposed opposite to a contact portion 31*b* of the cleaning blade 31 with the photoconductor drum 14, as illustrated in FIG. 5. Further, the tangential line B has the intersection point 31*c* closer to (the supporting bracket 39 of) the cleaning blade 31 than the contact position (i.e., the contact portion 31*b*) of the cleaning blade 31 with the photoconductor drum 14. According to this configuration, the particles of the residual toner T flicked off from the bristles 30*a* of the cleaning brush 30 are dispersed to an area of the non-contact surface 31*a* of the cleaning blade 31.

In FIG. 5, the contact portion 31*b* of the cleaning blade 31 with the surface of the photoconductor drum 14 is surrounded by an ellipse indicated by a one-dot chain line.

The cleaning blade 31 is disposed in contact with the photoconductor drum 14. According to this configuration, the residual toner flicked off by the cleaning brush 30 toward the downstream side from the contact portion 31*b* in the rotation direction of the photoconductor drum 14 is no longer attracted to the photoconductor drum 14. Further, the intersection point 31*c* is separated away from the contact portion 31*b*. This configuration can prevent a large amount of toner including the residual toner adhesion to the cleaning blade 31, and therefore does not adversely affect to wear of the cleaning blade 31.

Further, an almost full amount of residual toner flicked off in this region returns to the metallic roller 32 or the cleaning brush 30 along with the aid of gravity. After repeating the regular cleaning operation, the almost full amount of residual toner is collected to the waste toner conveying path. By contrast, the rest of residual toner adheres to the region of the non-contact surface 31*a* of the cleaning blade 31 and remains collected in the region without adversely affecting the image forming operations and the wear of the cleaning blade 31.

As described above, in the present invention, a center of the shaft 32*a* of the metallic roller 32 is disposed higher than a rotation center 30*c* of the cleaning brush 30 and the cleaning blade 31 is disposed above the rotation center 30*c* of the cleaning brush 30 in a vertical direction.

The present embodiment provides the above-described simple configuration in which the cleaning brush 30, the metallic roller 32, and the cleaning blade 31 are disposed such that the tangential line B has the intersection point 31*c* intersecting the non-contact surface 31*a* of the cleaning blade 31. According to the above-described operation in the present embodiment, even when the cleaning brush 30 and the metallic roller 32 rotate in the same direction, this configuration can prevent the residual toner flicked off from the cleaning brush 30 from being adhered to the photoconductor drum 14 again and from dispersing to the outside of the image forming apparatus 100. Further, the life of the cleaning unit 19 can be extended.

The above-described effects have been confirmed by conducting tests using the image forming apparatus 100 illustrated in FIG. 1, which is provided with the cleaning unit 19 that includes the cleaning blade 31, the cleaning brush 30, the metallic roller 32, and the metallic blade 35 having the above-described respective specifications and characteristic values.

It is to be noted that, when the length of the cleaning blade 31 in a direction to contact with the photoconductor drum 14 is relatively short, a surface of the supporting bracket 39 can function as a replacement of the non-contact surface 31*a* of the cleaning blade 31 to achieve the effect of the present embodiment.

Figure 6A:
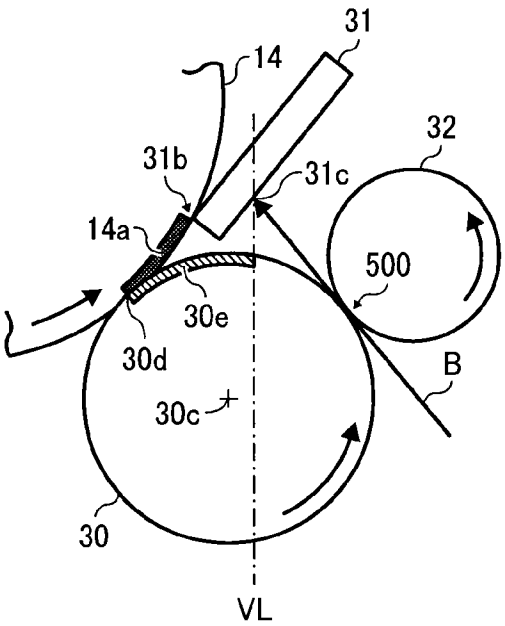
FIG. 6A is a diagram illustrating a structure in which a vertical line passing an intersection point is disposed closer to the metallic roller from a center of rotation of the cleaning brush.
Figure 6B:
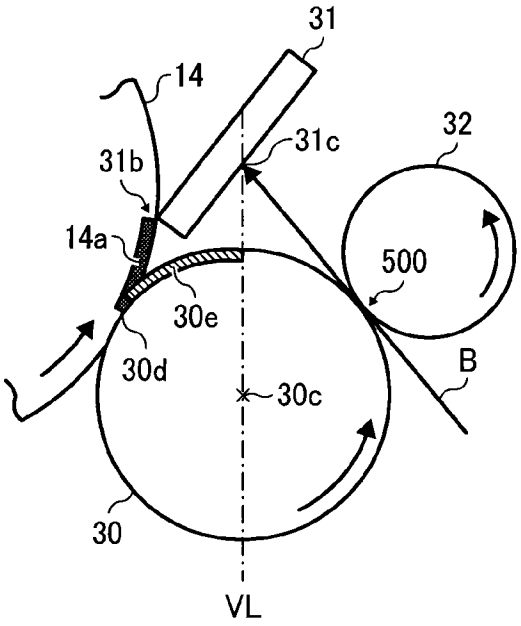
FIG. 6B is a diagram illustrating a structure in which the vertical line passing the intersection point is disposed to pass the center of rotation of the cleaning brush.
Figure 6C:
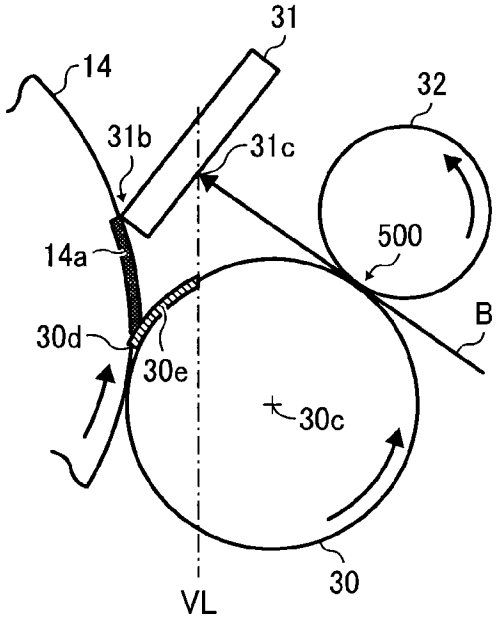
FIG. 6C is a diagram illustrating a structure in which the vertical line passing the intersection point is disposed closer to a photoconductor drum from the center of rotation of the cleaning brush.

A further description is given of the positions of the cleaning blade 31, the cleaning brush 30, and the metallic roller 32 with showing the positional relation of the intersection point 31*c* with respect to the tangential line B and the cleaning blade 31, with reference to FIGS. 6A through 6C. FIG. 6A illustrates an example configuration in which a vertical line VL indicated by a dot-dashed line passing through the intersection point 31*c* is located closer to the metallic roller 32 than the rotation center 30*c* of the cleaning brush 30. FIG. 6B illustrates an example configuration in which the vertical line VL passing through the intersection point 31*c* is located to pass through the rotation center 30*c* of the cleaning brush 30. FIG. 6C illustrates an example configuration in which the vertical line VL passing through the intersection point 31*c* is located closer to the photoconductor drum 14 than the rotation center 30*c* of the cleaning brush 30.

It is to be noted that preferable configurations among FIGS. 6A through 6C are the configurations illustrated in FIGS. 6A and 6B.

A part of residual toner (hereinafter, also simply referred to as "toner") that is flicked off by the cleaning brush 30 and contacted with the cleaning blade 31 falls along with the aid of gravity or float in the air. If the configuration of the cleaning unit 19 is FIG. 6A or FIG. 6B, there is a distance from a position immediately below the intersection point 31*c* of the cleaning brush 30 to a minor arc 14*a* indicated by a bold line, which is a part of the outer circumferential surface of the photoconductor 14. The minor arc 14*a* indicates a part of the outer circumferential surface of the photoconductor drum 14 in a range of from a contact center 30*d* between the photoconductor drum 14 and the cleaning brush 30 to the contact portion 31*b* of the cleaning blade 31 with the photoconductor drum 14. From the above-described relation, a surface area of the cleaning brush 30 to which the toner fell from the photoconductor 14 or floating adheres again increases in FIGS. 6A and 6B. Here, the surface area of the cleaning brush 30 represents a surface area formed on the minor arc 30*e* of the outer circumferential surface of the cleaning brush 30 that is indicated as a hatched area expanding from the contact center 30*d* to the intersection point 31*c* at which the cleaning blade 31 intersects with the vertical line VL in FIGS. 6A through 6C. Therefore, the toner fallen from the photoconductor drum 14 can be attached to the minor arc 14*a* of the photoconductor drum 14 again and collected by the photoconductor 14 easily. For this reason, the toner fell from the photoconductor drum 14 can adhere to a minor arc 30*e* of the cleaning brush 30 again and be collected easily, and therefore the toner is not likely to adhere to the minor arc 14*a* of the photoconductor drum 14.

By contrast, in the configuration illustrated in FIG. 6C, the toner fell from the photoconductor drum 14 adheres to the minor arc 30*e* of the cleaning brush 30, which is the same as the configurations illustrated in FIGS. 6A and 6B. However, since the minor arc 14*a* of the photoconductor 14 is located close to the minor arc 30*e* of the cleaning brush 30, the toner can fall from the surface (formed by the leading areas of the bristles 30*a*) of the cleaning brush 30. Therefore, it is likely that the toner applies a load to the cleaning blade 31 disposed at the downstream side in the rotation direction of the photoconductor drum 14. Similarly, when the toner floats, it is likely that the toner adheres to the minor arc 14*a* of the photoconductor drum 14.

As described above, in the present embodiment, the intersection point 31*c* is set to be located within a region between a position where the vertical line VL is arranged closer to the metallic roller 32 than the rotation center 30*c* of the cleaning brush 30 and a position where the vertical line VL passes a crossing point of the rotation center 30*c* of the cleaning brush 30.

Figure 7:
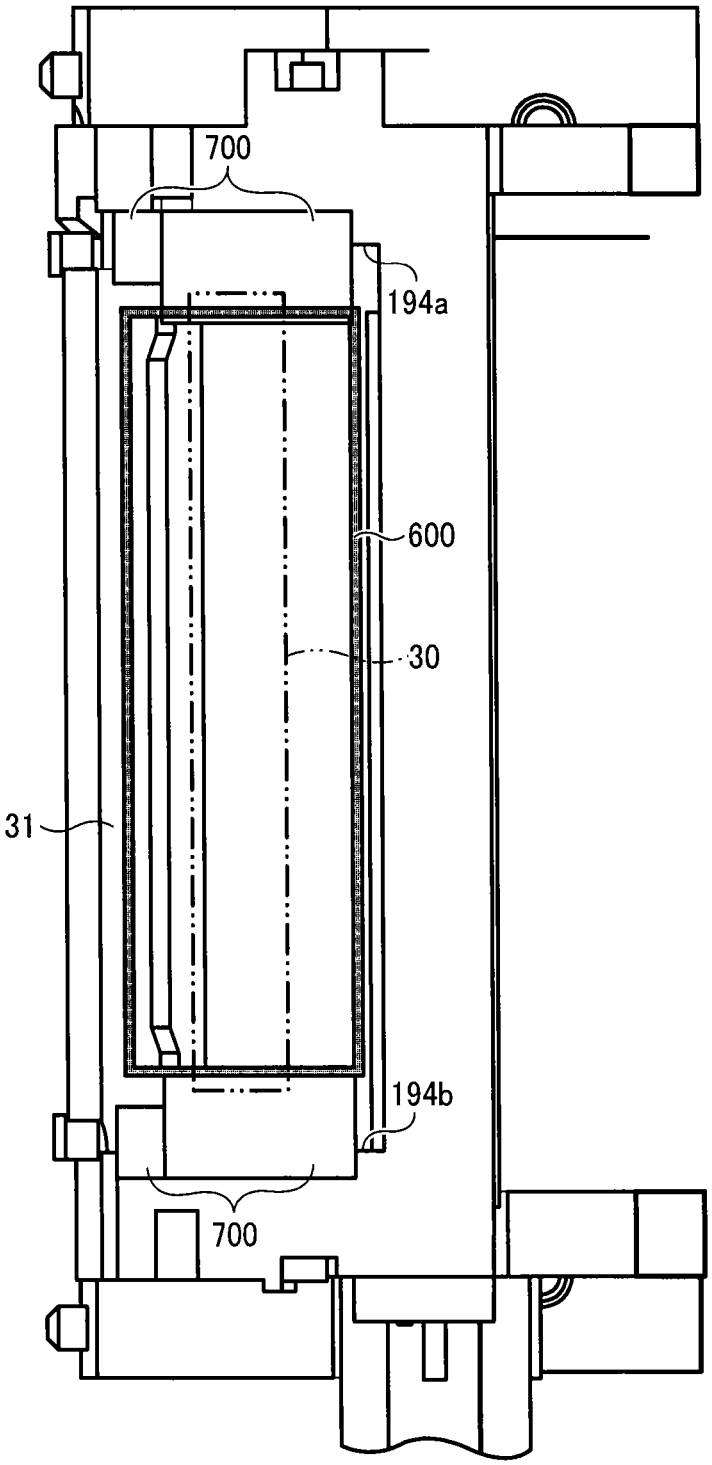
FIG. 7 is a partial cross-sectional bottom view illustrating the cleaning unit including the seal, viewed from bottom along a line of V5-V5 of FIG. 5.

Next, a description is given of details of the seal 600 with reference to FIGS. 5 and 7.

FIG. 7 is a partial cross-sectional bottom view, viewing from bottom along a line V5-V5 of the cleaning unit 19 of FIG. 5.

The seal 600 is a flexible member such as PET film sheet including mylar. As illustrated in FIGS. 5 and 7, one end of the seal 600 is attached and stuck to an upper surface of a fixing member 42 disposed on the fixed side part 352 of the L-shaped metallic blade 35 and the other end (the free end) of the seal 600 is in contact with the supporting bracket 39 that functions as a blade supporting member of the cleaning blade 31. A tip or leading area of an opposite end of the seal 600 contacts a surface of the supporting bracket 39 while being elastically bent downwardly along the surface of the supporting bracket 39. The seal 600 contacts extending over the whole length in a longitudinal direction of the photoconductor drum 14 and the cleaning blade 31. Further, the length in the longitudinal direction of the cleaning blade 31 is set longer than the length in the longitudinal direction of the seal 600.

It is to be noted that a virtual position of the cleaning brush 30 is illustrated with a two-dot chain line in FIG. 7 and that the length of the cleaning brush 30 in the longitudinal direction is set greater than the length of the seal 600 in the longitudinal direction. Further, the length of the cleaning blade 31 in the longitudinal direction is set to be equal to or longer than the length of the cleaning brush 30 in the longitudinal direction.

Side seals 700 are attached and stuck at both ends in the longitudinal direction of the seal 600. The side seals 700 are formed by a material different from the seal 600, which is, for example, formed polyurethane rubber or formed PUR so as to prevent toner dispersion from both edges in the longitudinal direction of the seal 600. One end of each side seal 700 is attached and stuck to the pair of sidewalls 194*a* and 194*b* integrally formed to both ends in the longitudinal direction of the container 191 and an opposite end thereof is overlaid on both ends in the longitudinal direction of the seal 600.

As described above, an open space above the cleaning brush 30, the metallic roller 32, and the metallic blade 35 in the container 191 are covered by the cleaning blade 31, the supporting bracket 39, the seal 600, and the side seals 700. Therefore, the seal 600 and the side seals 700 can prevent the residual toner flicked off by the cleaning brush 30 and floating in the open space from being leaked to the outside of the image forming apparatus 100.

It is to be noted that the fact that the cleaning brush 30, the metallic roller 32, and the metallic blade 35 are covered by the cleaning blade 31, the supporting bracket 39, and the seal 600 means in the present embodiment that the cleaning brush 30, the metallic roller 32, and the metallic blade 35 are substantially or closely closed by the cleaning blade 31, the supporting bracket 39, and the seal 600. When a power source switch of the image forming apparatus 100 is on, the cleaning unit 19 is operating, and therefore the charger 321 of FIG. 2 positively charges the metallic blade 35. When the cleaning unit 19 is not operating, it is inferred that the contact portion between the photoconductor drum 14 and the cleaning brush 30 (specifically, an upstream portion of the contact portion in the rotation direction of the photoconductor drum 14) is open or has a gap so that air or the toner can pass therethrough. However, as illustrated in FIG. 3, while the cleaning unit 19 is operating, it is regarded that the cleaning brush 30, the metallic roller 32, and the metallic blade 35 are substantially or closely closed by the cleaning blade 31, the supporting bracket 39, and the seal 600, including the upstream portion of the contact portion between the photoconductor drum 14 and the cleaning brush 30 in the rotation direction of the photoconductor drum 14. This is because, while the cleaning unit 19 is operating, the contact portion between the photoconductor drum 14 and the cleaning brush 30 can electrically restore the negatively charged toner by the positively charged multiple bristles 30*a*.

The above-described embodiment employs the cleaning unit 19. However, the configuration according to the present embodiment can be applied to a cleaning unit 19A as illustrated in FIG. 8.

Figure 8:
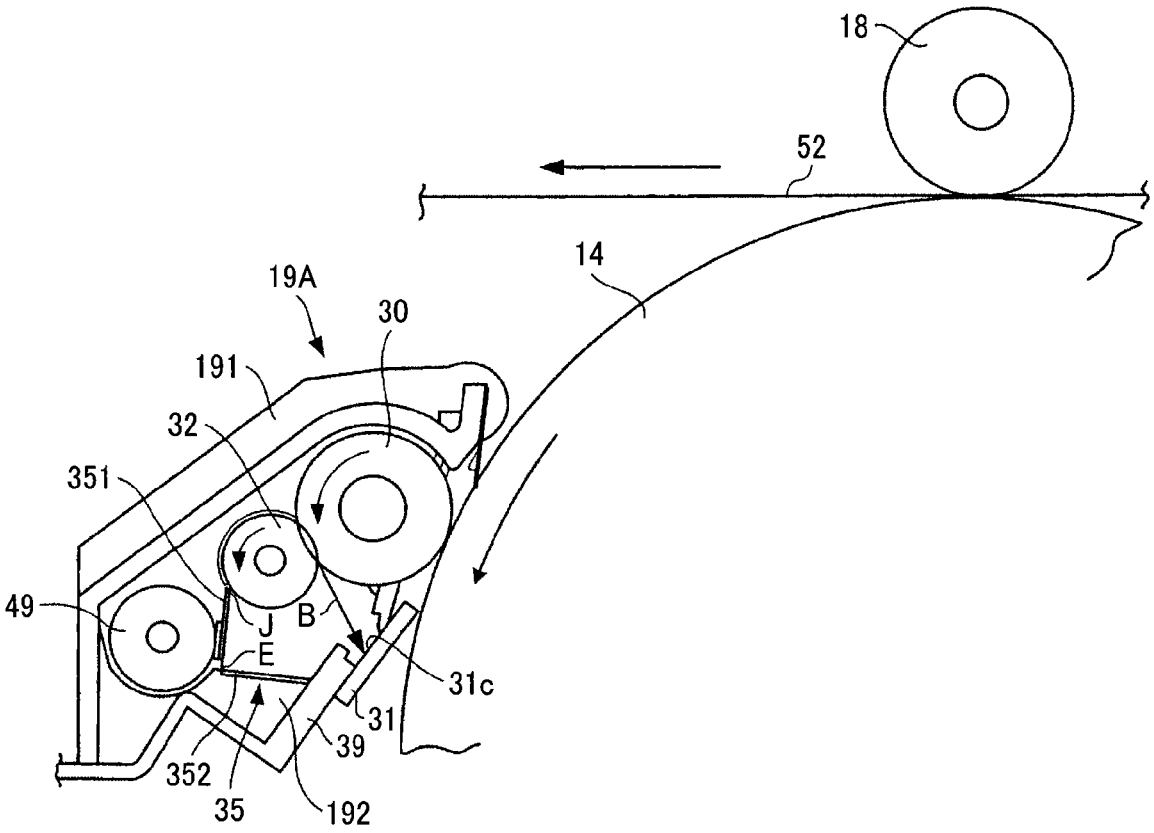
FIG. 8 is an enlarged cross-sectional view illustrating a cleaning unit according to a modification.

FIG. 8 is a diagram illustrating a main part of the cleaning unit 19A that can be provided to the image forming apparatus 100 as a configuration of an alternative example of the cleaning unit 19.

The elements or components of the cleaning unit 19A are similar in structure and functions to the elements or components of the cleaning unit 19 as shown in FIGS. 1 through 5, except that the configuration including the cleaning unit 19A has the photoconductor drum 14 disposed below the primary transfer roller 18 as illustrated in FIG. 8 while the configuration including the cleaning unit 19 has the photoconductor drum 14 disposed above the primary transfer roller 18 as illustrated in FIGS. 1 and 2. The elements or components of an image forming apparatus 100A including the cleaning unit 19A may be denoted by the same reference numerals as those of the image forming apparatus 100, and the descriptions thereof are omitted or summarized. This configuration of the alternative example can be applied to the present invention.

In the alternative example, the position of the conveyance screw 49 is below the metallic roller 32 and downstream from the metallic roller 32 in the rotation direction of the photoconductor drum 14. The conveyance screw 49 scrapes the residual toner T attached to the metallic roller 32 from below and conveys the scraped residual toner T to the waste toner conveying path.

The metallic blade 35 includes the edge side part 351 having the edge J disposed in contact with the outer surface of the metallic roller 32 at one side of the bent portion E and the fixed side part 352 at the other side of the belt portion E, and is fixed to the attaching portion 192 of the container 191.

With the configuration of this alternative example illustrated in FIG. 8, the same effect as the above-described embodiment can be achieved.

The configurations according to the above-described embodiment are examples. The present invention can achieve the following aspects effectively.

[Aspect 1]

In Aspect 1, a cleaning unit (for example, the cleaning unit 19) has a configuration including a brush rotary body (for example, the cleaning brush 30), a toner collecting rotary body (for example, the metallic roller 32), a toner collecting blade (for example, the metallic blade 35), and a cleaning blade (for example, the cleaning blade 31). The brush rotary body is disposed in contact with an image carrier (for example, the photoconductor drum 14) provided in an image forming apparatus (for example, the image forming apparatus 100) and removes toner on the image carrier and holding the toner thereon. The toner collecting rotary body is disposed in contact with the brush rotary body and collects the toner held on the brush rotary body. The toner collecting blade is disposed in contact with the toner collecting rotary body and scrapes the toner adhered to the toner collecting rotary body. The cleaning blade is disposed in contact with the image carrier at a downstream side from the brush rotary body in a rotation direction of the image carrier and scrapes the toner falling from the brush rotary body. The image carrier, the brush rotary body, and the toner collecting rotary body rotate in the same direction. The cleaning blade, the brush rotary body, and the toner collecting rotary body are located to cause a tangential line (for example, tangential line B) passing through a contact area (the contact area 500) of the brush rotary body and the toner collecting rotary body on an outer peripheral circle (for example, the outer peripheral circle 130) around a shaft (for example, the shaft 30*b*) of the brush rotary body to have an intersection point (for example, the intersection point 31*c*) intersecting a non-contact surface (for example, the non-contact surface 31*a*) disposed opposite to a contact portion (for example, the contact portion 31*b*) of the cleaning blade with the image carrier.

According to Aspect 1, as described in the embodiments, even if the brush rotary body and the toner collecting rotary body rotate in the same direction, the configuration can prevent the toner flicked off from the brush rotary body from attaching to the image carrier or dispersing to the outside of the image forming apparatus. As a result, the cleaning unit can extends its life of use.

[Aspect 2]

According to Aspect 1, the intersection point (for example, the intersection point 31*c*) is located closer to the cleaning blade than the contact portion (for example, the contact portion 31 *b*) of the cleaning blade (for example, the cleaning blade 31) and the image carrier (for example, the photoconductor drum 14).

Accordingly, as described in the above-described embodiments, the configuration of Aspect 2 can achieve an effective to prevent a large amount of toner input or adhesion to the cleaning blade, therefore does not adversely affect to wear of the cleaning blade.

[Aspect 3]

According to Aspect 2, wherein the cleaning blade (for example, the cleaning blade 31) includes a blade supporting member (for example, the supporting bracket 39) to support the cleaning blade disposed in contact with the image carrier (for example, the photoconductor drum 14). The intersection point (for example, the intersection point 31*c*) is arranged on the blade supporting member.

With this configuration of Aspect 3, the blade supporting member can function as a replacement of the cleaning blade when the length of the cleaning blade to the surface of the photoconductor is relatively short.

[Aspect 4]

According to Aspect 1, the intersection point (for example, the intersection point 31*c*) is located within a range of from a position at which a vertical line (for example, the vertical line VL) passing the intersection point on the non-contact surface is located away from the center (for example, the rotation center 30*c*) of the brush rotary body (for example, the cleaning brush 30) toward the toner collecting rotary body (for example, the metallic roller 32) to a position at which the vertical line passes the center of the brush rotary body.

Accordingly, as described in the above-describe embodiments, this configuration of Aspect 4 can achieve the effect as Aspect 1 reliably.

[Aspect 5]

According to Aspect 4, an axial center (for example, the shaft 32*a*) of the toner collecting rotary body (for example, the metallic roller 32) is disposed higher than the center (for example, the rotation center 30*c*) of the brush rotary body (for example the cleaning brush 30) and the cleaning blade (for example, the cleaning blade 31) is disposed above the center of the brush rotary body in a vertical direction.

Accordingly, as described in the above-describe embodiments, this configuration of Aspect 5 can achieve the effect as Aspect 4 reliably.

[Aspect 6]

According to Aspect 4, an axial center (for example, the shaft 32*a*) of the toner collecting rotary body (for example, the metallic roller 32) is disposed lower than the center (for example, the rotation center 30*c*) of the brush rotary body (for example the cleaning brush 30) and the cleaning blade (for example, the cleaning blade 31) is below the center of the brush rotary body in a vertical direction.

Accordingly, as described in the above-describe embodiments, this configuration of Aspect 6 can achieve the effect as Aspect 4 reliably.

[Aspect 7]

According to Aspect 1, an axial center (for example, the shaft 32*a*) of the toner collecting rotary body (for example, the metallic roller 32) is disposed higher than the center (for example, the rotation center 30*c*) of the brush rotary body (for example the cleaning brush 30) and the cleaning blade (for example, the cleaning blade 31) is disposed above the center of the brush rotary body in a vertical direction.

Accordingly, as described in the above-describe embodiments, this configuration of Aspect 7 can achieve the effect as Aspect 1 reliably.

[Aspect 8]

According to Aspect 1, the cleaning unit (for example, the cleaning unit 19) further includes a fixing member (for example, the fixing member 42) disposed above the toner collecting rotary body (for example, the metallic roller 32) to fix the toner collecting blade (for example, the metallic roller 32), a blade supporting member (for example, the supporting bracket 39) to support the cleaning blade (for example, the cleaning blade 31), and a seal (for example, the seal 600). One end of the seal is fixed to the fixing member and the opposite end of the seal contacts the blade supporting member.

Accordingly, as described in the above-described embodiments, the seal covers the open space above the brush rotary body (for example, the cleaning brush 30), the blade supporting member, and the toner collecting blade (for example, the metallic blade 35). Therefore, the seal can prevent the residual toner flicked off by the brush rotary body and floating in the open space from being leaked to the outside of the image forming apparatus.

[Aspect 9]

According to Aspect 8, the seal (for example, the seal 600) is disposed over the image carrier (for example, the photoconductor drum 14) in a longitudinal direction thereof. The length of the cleaning blade (for example, the cleaning blade 31) in the longitudinal direction is greater than the length of the seal in the longitudinal direction. The brush rotary body (for example, the cleaning brush 30), the toner collecting rotary body (for example, the metallic roller 32), and the toner collecting blade (for example, the metallic blade 35) are covered by the blade supporting member (for example, the blade supporting bracket 39) and the seal.

Accordingly, as described in the above-described embodiments, this configuration of Aspect 9 can achieve the effect as Aspect 8 reliably.

[Aspect 10]

According to Aspect 8, the length of the brush rotary body (for example, the cleaning brush 30) in the longitudinal direction is greater than the length of the seal (for example, the seal 600) in the longitudinal direction. The length of the cleaning blade (for example, the cleaning blade 31) in the longitudinal direction is equal to or greater than the length of the brush rotary body (for example, the cleaning brush 30) in the longitudinal direction.

Accordingly, as described in the above-described embodiments, this configuration of Aspect 10 can achieve the effect as Aspect 8 reliably.

[Aspect 11]

According to Aspect 8, the seal (for example, the seal 600) includes side seals (for example, the side seals 700) disposed at both ends of the seal in the longitudinal direction. One end of the side seal is attached to a sidewall (for example, the pair of sidewalls 194*a* and 194*b*) and the opposite end of the side seal is overlaid on both ends of the seal in the longitudinal direction.

Accordingly, as described in the above-described embodiments, this configuration of Aspect 11 can achieve the effect as Aspect 8 reliably.

[Aspect 12]

According to Aspect 1, the brush rotary body (for example, the cleaning brush 30) and the toner collecting rotary body (for example, the metallic roller 32) are formed by conductive material and are charged to the same polarity.

Accordingly, as described in the above-described embodiments, the configuration of Aspect 12 can electrostatically collect the residual toner including an untransferred toner remaining on the surface of the photoconductor drum 14 reliably.

[Aspect 13]

According to Aspect 1, a process cartridge (for example, the process cartridges 11Y, 11M, 11C, and 11K) is detachably attachable to an apparatus body (for example, the apparatus body 110) of an image forming apparatus (for example, the image forming apparatus 100) and integrally includes the cleaning unit (for example, the cleaning unit 19) and at least one of an image carrier (for example, the photoconductor drum 14) to form an image on a surface thereof, a charger (for example, the charger 15) to uniformly charge the image carrier, and a development unit (for example, the development unit 16) to develop an image on the image carrier charged by the charger.

Accordingly, the process cartridge of Aspect 13 can achieve the same effect as Aspect 1 and facilitate replacement of the cleaning unit.

[Aspect 14]

According to Aspect 1, an image forming apparatus (for example, the image forming apparatus 100) includes an image forming device (for example, the process cartridges 11Y, 11M, 11C, and 11K) to form an image on a recording medium (for example, the recording medium P) and the cleaning unit (for example, the cleaning unit 19).

Accordingly, the image forming apparatus of Aspect 14 can achieve the same effect as any one of Aspects 1 through 13.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A cleaning unit comprising:

a brush rotary body disposed in contact with an image carrier provided in an image forming apparatus, the brush rotary body removing toner on the image carrier and holding the toner thereon;

a toner collecting rotary body disposed in contact with the brush rotary body, the toner collecting rotary body collecting the toner held on the brush rotary body;

a toner collecting blade disposed in contact with the toner collecting rotary body, the toner collecting blade scraping the toner adhered to the toner collecting rotary body; and a cleaning blade disposed in contact with the image carrier at a downstream side from the brush rotary body in a rotation direction of the image carrier, the cleaning blade member scraping the toner falling from the brush rotary body, wherein the image carrier, the brush rotary body, and the toner collecting rotary body rotate in the same direction, wherein the cleaning blade, the brush rotary body, and the toner collecting rotary body are located to cause a tangential line passing through a contact area of the brush rotary body and the toner collecting rotary body on an outer peripheral circle around a shaft of the brush rotary body to have an intersection point intersecting a non-contact surface of the cleaning blade disposed opposite to a contact portion of the cleaning blade with the image carrier, wherein said tangential line also intersects a surface of the image carrier.

2. The cleaning unit according to claim 1, wherein the intersection point is located closer to a support bracket of the cleaning blade than the contact portion of the cleaning blade with the image carrier.

3. The cleaning unit according to claim 2, further comprising said blade supporting member to support the cleaning blade disposed in contact with the image carrier, wherein the intersection point is arranged on the blade supporting member.

4. The cleaning unit according to claim 1, wherein the intersection point is located within a range from a position at which a vertical line passing the intersection point on the non-contact surface is located away from the center of the brush rotary body toward the toner collecting rotary body to a position at which the vertical line passes the center of the brush rotary body.

5. The cleaning unit according to claim 4, wherein an axial center of the toner collecting rotary body is disposed higher than the center of the brush rotary body, wherein the cleaning blade is disposed above the center of the brush rotary body in a vertical direction.

6. The cleaning unit according to claim 4, wherein an axial center of the toner collecting rotary body is disposed lower than the center of the brush rotary body, wherein the cleaning blade is below the center of the brush rotary body in a vertical direction.

7. The cleaning unit according to claim 1, wherein an axial center of the toner collecting rotary body is disposed higher than a center of the brush rotary body, wherein the cleaning blade is disposed above the center of the brush rotary body in a vertical direction.

8. The cleaning unit according to claim 1, wherein the brush rotary body and the toner collecting rotary body are formed by conductive material and are charged to the same polarity.

9. A process cartridge detachably attachable to an apparatus body of an image forming apparatus, the process cartridge comprising the cleaning unit according to claim 1; and at least one of an image carrier to form an image on a surface thereof;

a charger to uniformly charge the image carrier; and a development device to develop the image on the image carrier charged by the charger.

10. An image forming apparatus comprising:

an image forming device to form an image on a recording medium; and the cleaning unit according to claim 1.

11. A cleaning unit, comprising:

a brush rotary body disposed in contact with an image carrier provided in an image forming apparatus, the brush rotary body removing toner on the image carrier and holding the toner thereon;

a toner collecting rotary body disposed in contact with the brush rotary body, the toner collecting rotary body collecting the toner held on the brush rotary body;

a toner collecting blade disposed in contact with the toner collecting rotary body, the toner collecting blade scraping the toner adhered to the toner collecting rotary body;

a cleaning blade disposed in contact with the image carrier at a downstream side from the brush rotary body in a rotation direction of the image carrier, the cleaning blade member scraping the toner falling from the brush rotary body;

a fixing member disposed above the toner collecting rotary body to fix the toner collecting blade;

a support member to support the cleaning blade; and a seal, one end of which being fixed to the fixing member and an opposite end of which contacting the support member;

wherein the image carrier, the brush rotary body, and the toner collecting rotary body rotate in the same direction, wherein the cleaning blade, the brush rotary body, and the toner collecting rotary body are located to cause a tangential line passing through a contact area of the brush rotary body and the toner collecting rotary body on an outer peripheral circle around a shaft of the brush rotary body to have an intersection point intersecting a non-contact surface of the cleaning blade disposed opposite to a contact portion of the cleaning blade with the image carrier.

12. The cleaning unit according to claim 11, wherein the seal is disposed over the image carrier in a longitudinal direction of the image carrier, wherein a length of the cleaning blade in the longitudinal direction is greater than a length of the seal in the longitudinal direction, wherein the brush rotary body, the toner collecting rotary body, and the toner collecting blade are covered by the blade supporting member and the seal.

13. The cleaning unit according to claim 11, wherein a longitudinal length of the brush rotary body is greater than a longitudinal length of the seal, wherein a longitudinal length of the cleaning blade is equal to or greater than a longitudinal length of the brush rotary body.

14. The cleaning unit according to claim 11, wherein the seal includes side seals disposed at both ends of the seal in a longitudinal direction of the seal, wherein one end of the side seal is attached to a sidewall and an opposite end of the side seal is overlaid on the both ends of the seal in the longitudinal direction.

15. A process cartridge detachably attachable to an apparatus body of an image forming apparatus, the process cartridge comprising:

the cleaning unit according to claim 11; and at least one member selected from the group consisting of an image carrier to form an image on a surface thereof; a charger to uniformly charge the image carrier; and a development device to develop the image on the image carrier charged by the charger.

16. An image forming apparatus comprising:

an image forming device to form an image on a recording medium; and the cleaning unit according to claim 11.

17. A cleaning unit comprising:

a brush rotary body disposed in contact with an image carrier provided in an image forming apparatus, the brush rotary body removing toner on the image carrier and holding the toner thereon, wherein a center of the brush rotary body is located lower than a center of the image carrier;

a toner collecting rotary body disposed in contact with the brush rotary body, the toner collecting rotary body collecting the toner held on the brush rotary body;

a toner collecting blade disposed in contact with the toner collecting rotary body, the toner collecting blade scraping the toner adhered to the toner collecting rotary body; and a cleaning blade disposed in contact with the image carrier at a downstream side from the brush rotary body in a rotation direction of the image carrier, the cleaning blade member scraping the toner falling from the brush rotary body, wherein the image carrier, the brush rotary body, and the toner collecting rotary body rotate in the same direction, wherein the cleaning blade, the brush rotary body, and the toner collecting rotary body are located to cause a tangential line passing through a contact area of the brush rotary body and the toner collecting rotary body on an outer peripheral circle around a shaft of the brush rotary body to have an intersection point intersecting a non-contact surface of the cleaning blade disposed opposite to a contact portion of the cleaning blade with the image carrier.

18. A process cartridge detachably attachable to an apparatus body of an image forming apparatus, the process cartridge comprising:

the cleaning unit according to claim 17; and at least one member selected from the group consisting of an image carrier to form an image on a surface thereof; a charger to uniformly charge the image carrier; and a development device to develop the image on the image carrier charged by the charger.

19. An image forming apparatus comprising:

an image forming device to form an image on a recording medium; and the cleaning unit according to claim 17.

* * * * *